United States Patent [19]

Shapiro-Baruch

[11] Patent Number: 5,052,191

[45] Date of Patent: Oct. 1, 1991

[54] METHOD AND APPARATUS FOR HEAT PUMP DEFROST

[75] Inventor: Ian M. Shapiro-Baruch, Syracuse, N.Y.

[73] Assignee: Carrier Corporation, Syracuse, N.Y.

[21] Appl. No.: 581,938

[22] Filed: Sep. 13, 1990

[51] Int. Cl.[5] ..... F25B 27/00

[52] U.S. Cl. ..... 62/238.7; 62/278; 62/324.1

[58] Field of Search ..... 62/238.7, 324.1, 277, 62/278

[56] References Cited

U.S. PATENT DOCUMENTS

| | | | |
|---|---|---|---|
| Re. 29,966 | 4/1979 | Nussbaum | 62/150 |
| 2,961,848 | 11/1960 | Nonomaque | 62/278 |
| 3,274,793 | 9/1966 | Anderson et al. | 62/151 |
| 4,012,921 | 3/1977 | Willitts et al. | 62/151 |
| 4,083,195 | 4/1978 | Kramer et al. | 62/278 X |
| 4,646,539 | 3/1987 | Taylor | 62/278 |
| 4,736,596 | 4/1988 | Iquchi et al. | 62/278 X |
| 4,766,734 | 8/1988 | Dudley | 62/160 |
| 4,798,059 | 1/1989 | Morita | 62/278 X |
| 4,918,933 | 4/1990 | Dyer | 62/238.7 |

*Primary Examiner*—Lloyd L. King

[57] ABSTRACT

A method and apparatus for defrosting the outside heat exchanger of a reversible vapor compression refrigeration (heat pump) system. The method and apparatus are particularly suited for use with smaller systems that employ a single fan motor to drive both the inside and outside heat exchanger fans. A heat storage apparatus is mounted in heat exchange relationship with the refrigerant piping between the system flow reversing valve and the inside heat exchanger. During operation in the heating mode, heat from the refrigerant is transferred to and stored in the heat storage apparatus. During operation in the defrosting mode, the refrigerant flow in the system is aligned as in the cooling mode but both fans are shut off. Heat stored in the heat storage apparatus is transferred to and used for defrosting the outside heat exchanger. The apparatus has little or no effect on system operation in the cooling mode.

7 Claims, 1 Drawing Sheet

METHOD AND APPARATUS FOR HEAT PUMP DEFROST

BACKGROUND OF THE INVENTION

This invention relates generally to reversible vapor compression refrigeration (heat pump) systems. More particularly, the invention relates to a method and apparatus for warming the outside heat exchanger of a heat pump system periodically when the system is operating in the heating mode in order to remove frost and ice accumulations. The typical heat pump system for heating and cooling an enclosed space comprises a compressor, an outside heat exchanger, an inside heat exchanger, expansion devices and a flow reversing valve. In the cooling mode, the inside heat exchanger functions as the evaporator in an otherwise standard vapor compression refrigeration cycle. In the heating mode, refrigerant flow through the two heat exchangers is reversed and the outside heat exchanger functions as the evaporator A fan circulates air from the space to be During operation in the heating mode, frost and ice can form on the external surfaces of the outside heat exchanger of a heat pump system, degrading system performance. To eliminate the buildup, the heat pump is periodically placed in a defrost mode of operation in order to melt any frost and ice from the heat exchanger.

One widely used method of heat pump defrosting is to operate the system for a short time with the refrigeration flow aligned as in the air conditioning mode but with the outside fan shut off. The inside fan continues to operate with heat being removed from the space to be heated and used to defrost the outside heat exchanger.

Small window mounted or room air conditioning heat pump systems commonly employ a single motor to operate both the inside and outside fans. The two fans are both mounted on the rotor shaft of the motor and cannot operate independently. Therefore, the defrosting method described above cannot be used with heat pump systems having a single fan motor. In such systems, defrosting of the outside heat exchanger may be accomplished in a number of ways including:

Passive defrost - The refrigeration compressor does not operate while the outside heat exchanger temperature us allowed to rise to the outside temperature, which must Passive Defrost - The heat pump refrigeration cycle does not operate while the outside heat exchanger lengthy process and result in high operating costs due to the use of electric heat. The requirement for supplemental electric heaters also raises the unit initial cost.

Fan off defrost - The compressor operates but the fans do not. Thus the heat for defrosting comes only from that added to the system by the compressor. This is also an inefficient and lengthy process during which the system cannot provide any space heating capability. The method may not be effective at low outside temperatures and may also require a supplemental orifice and associated solenoid valve, thus increasing the cost of the unit. Further, liquid refrigerant floodback, with resultant possibility of compressor damage, is likely when using this method.

Because both of the above defrosting methods may be ineffective at low outside air temperatures, their use is rendered unsuitable except for heat pump systems designed for mild climates.

What is needed therefore is an effective and economical means for defrosting, under a wide range of climatic conditions, the outside heat exchanger of a heat pump system having heat exchanger fans that cannot be operated independently.

SUMMARY OF THE INVENTION

An object of the present invention is to enable defrosting of the outside heat exchanger of a heat pump system without requiring the operation of heat exchanger fans or supplemental heaters, even in conditions of low outside air temperatures.

Another object of the present invention is to enable defrosting of a heat pump outside heat exchanger without subjecting the system compressor to the possibility of flooding with liquid refrigerant.

A still further object of the present invention is to enable defrosting of a heat pump outside heat exchanger by a means that is economical and produces high heating seasonal performance factor ratings.

The present invention achieves these and other objects by placing a heat storage device in heat exchange relationship with the heat pump system refrigerant piping between the flow reversing valve and the inside heat exchanger. When the system is in the heating mode, refrigerant passing through this portion of the refrigerant flow loop is relatively hot. Heat is transferred from the hot refrigerant to the heat storage device. Then, when the system is in the defrosting mode, with both heat exchanger fans shut off and the refrigerant flow through the outside and inside heat exchangers reversed, heat from the heat storage device warms the refrigerant flowing to, and thus defrosts, the outside heat exchanger.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
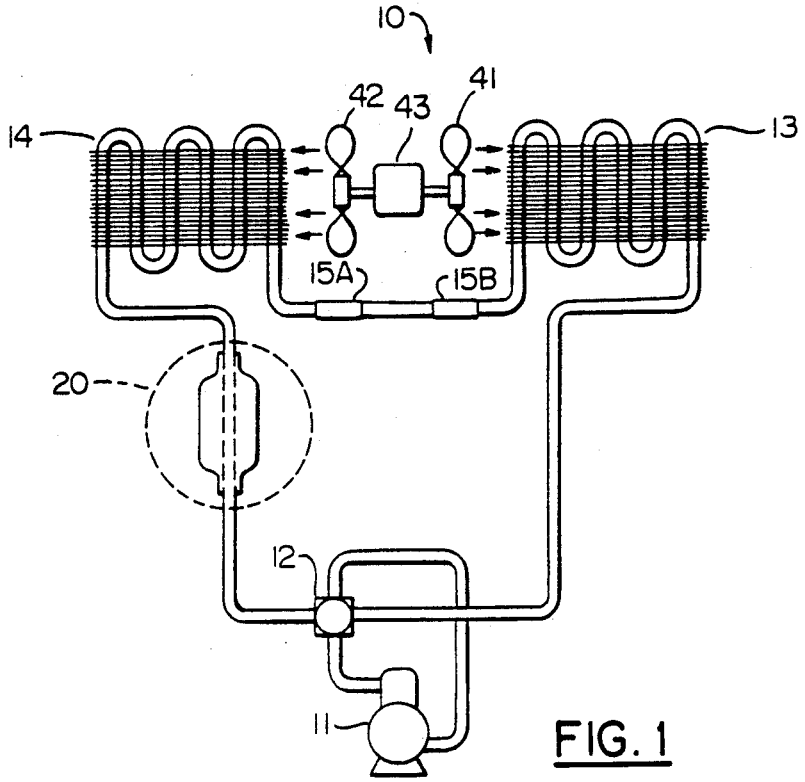
FIG. 1 is a schematic of a reversible vapor compression refrigeration or heat pump system incorporating the apparatus of the present invention.

FIG. 1 depicts a schematic representation of an otherwise conventional reversible vapor compression refrigeration or heat pump system incorporating the apparatus of the present invention. In FIG. 1, heat pump system 10 comprises compressor 11, flow reversing valve 12, outside heat exchanger 14, inside heat exchanger 13 and expansion devices 15A and 15D, all interconnected in a closed refrigerant flow loop. Heat storage apparatus 20 is installed around and in a heat exchange relationship with the refrigerant piping between flow reversing valve 12 and inside heat exchanger 14. Outside fan 42 and inside fan 41, both driven by fan motor 43, circulate air through their respective heat exchangers. Expansion devices 15A and 15B may each be a single device or a combination of devices offering little or no resistance to refrigerant flow in one direction and metering or restricting refrigerant flow in the other direction. The devices are installed so that, for a given flow direction, one device is offering low flow resistance while the other is metering or restricting flow.

In the cooling mode, flow reversing valve 12 is aligned so that the circulation of refrigerant is from the discharge of compressor 11, then through flow reversing valve 12, outside heat exchanger 13, expansion device 15B, expansion device 15A, inside heat exchanger 14, flow reversing valve 12 to the suction of compressor 12. Motor 43 operates fans 41 and 42.

In the heating mode, flow reversing valve 12 is aligned so that the circulation of refrigerant is from the discharge of compressor 13 then through flow reversing valve 12, inside heat exchanger 14, expansion device 15A, expansion device 15B, outside heat exchanger 14, flow reversing valve 12 to the suction of compressor 12 Motor 13 operates fans 41 and 42. In both the heating and the cooling modes, the highest refrigerant temperature in the loop is found at the discharge of compressor 11 and the lowest temperature is found at the compressor suction.

In the defrosting mode, flow reversing valve 12 is aligned so that refrigerant flow is the same as in the cooling mode, but fan motor 43 is off, hence fans 41 and 42 are not operating.

In the heating mode, heat storage apparatus 20 absorbs and stores heat at or near the temperature of the refrigerant in the warmest part of the loop. When there is a call for defrost, heat transferred from heat storage apparatus 20 warms the refrigerant passing through it. The warmed refrigerant then passes through the compressor and to the indoor heat exchanger. Because fan 41 is not operating, the warmed refrigerant passes through inside heat exchanger 14 with little or no heat loss and passes into outside heat exchanger 13, warming and melting any ice on the coils of the heat exchanger. Because fan 42 is not operating, nearly all of the heat energy in the warm refrigerant is available for defrosting.

Figure 2:
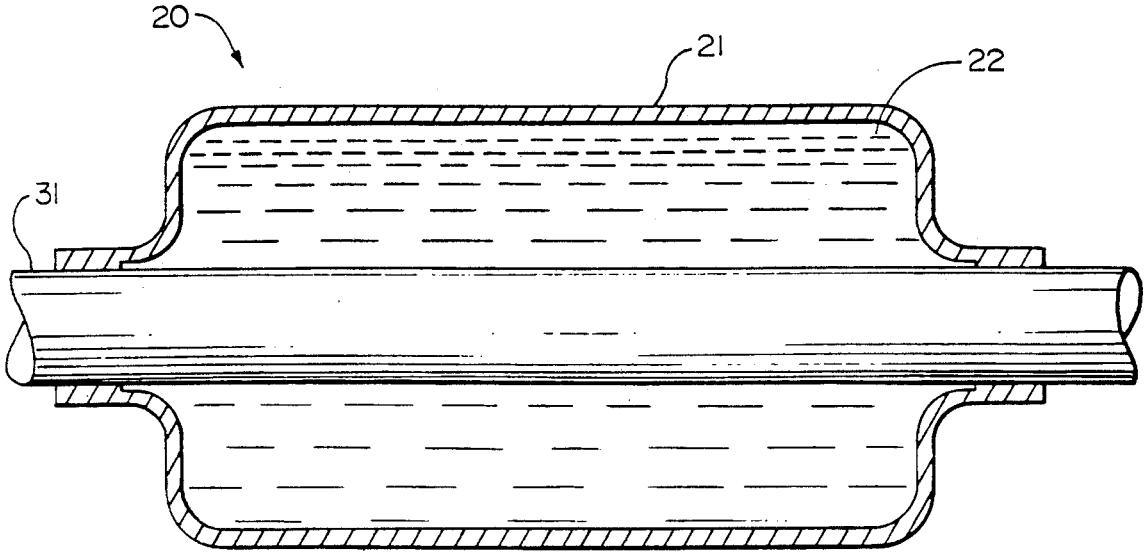
FIG. 2 is a cross sectioned elevation view of the present invention.

FIG. 2 is a sectioned elevation view of heat storage apparatus 20. Heat storage apparatus 20 comprises generally cylindrical casing 21 enclosing and containing heat storage medium 22. Casing 21 fits around a portion 31 of the refrigerant piping of heat pump system 10 and is sealed at its ends to prevent leakage. Casing 21 can be fabricated of any suitable material such as a flexible or semirigid plastic. Heat storage medium 22 can be any suitable material. The selected material should, among its other desired properties, undergo a change of state at or somewhat below the temperature of the refrigerant in the warmest portion of the loop. An excellent choice is paraffin. It is relatively inexpensive, nontoxic and nonhazardous and has a melting point of about 5420 C. (130° F.). In a system using refrigerant R-22 and operating in the heating mode, the refrigerant temperature at the compressor discharge is about 65° C. (150° F.). In the same system operating in the defrosting mode, the refrigerant temperature at the compressor suction is about −12° C. (10° F.). Thus, in the heating mode, the discharge refrigerant temperature is high enough to melt the paraffin heat storage medium and, in the defrost mode, the suction refrigerant temperature is low enough to cause the paraffin to change state back to a solid, releasing heat to the refrigerant. In the cooling mode, the paraffin as a heat storage medium remains in a solid state and has little or no effect on system performance.

The amount of paraffin required to function effectively as a source of heat for defrosting is not large. The heat required for defrosting is about 28 calories/kw of nominal cooling capacity (ncc) (400 Btu/ton ncc). The specific heat of paraffin is about 5.6 cal/kg (100 Btu/lb). Therefore about 500 g of paraffin per kw ncc (4 lb/ton ncc) is sufficient to provide the necessary heat for defrosting. The specific gravity of paraffin is 0.89. Therefore about 0.56 l of paraffin is required per kw ncc (2 qt per ton ncc). Thus a 2.3 kw (8,000 Btu/hr) room air conditioner/heat pump system, typical of the capacity and design of a system for which the present design is most suitable, would require about 1.3 l (1.5 qt) of paraffin heat storage medium. This assumes that only the latent heat of fusion is available for defrost. In fact, under the usual conditions of operation, there will be some sensible heat available in the heat storage medium. In addition, the operation of the compressor will add heat energy to the system during the defrosting mode. The amount of paraffin required can correspondingly be reduced.

While one embodiment of the present invention is described and discussed above, others may occur to those skilled in the art. The reader should interpret the extent that the inventor believes to be the scope of his invention solely by the scope of below claims.

What is claimed is:

1. In a reversible vapor compression air conditioning system having a cooling mode of operation, a heating mode of operation and a defrosting mode of operation and having a compressor with a suction and a discharge, an outside heat exchanger, an inside heat exchanger, refrigerant expansion means, a single refrigerant flow reversing valves and interconnecting refrigerant conduit that serially connect and allow reversible refrigerant flow through said flow reversing valve, said outside heat exchanger, said expansion means and said inside heat exchanger and having a heating mode refrigerant flow path in which said flow reversing valve is aligned so that refrigerant from said compressor discharge flows first from said flow reversing valve to said inside heat exchanger and a refrigerant flow path common to both said cooling and said defrosting modes of operation in which said flow reversing valve is aligned so that refrigerant from said compressor discharge flows first from said flow reversing valve to said outside heat exchanger, a method of storing and supplying heat to defrost said outside heat exchanger comprising:

transferring heat, while said system is operating in said heating mode of operation, from refrigerant flowing in that portion of said interconnecting refrigerant conduit that lies between said refrigerant flow reversing valve and said inside heat exchanger to heat storage means in heat exchange relationship with said portion of said conduit and transferring heat, while said system is operating in said defrosting mode of operation, from said heat storage means to refrigerant flowing in said portion of said conduit.

2. The method of claim 1 in which said air conditioning system also has fan means for moving air through said outside heat exchanger and fan means for moving air through said inside heat exchanger, both of said fan means being interconnected so that neither of said fan means is capable of operation independently of the other of said fan means.

3. In a reversible vapor compression air conditioning system having a cooling mode of operation, a heating mode of operation and a defrosting mode of operation and having a compressor with a suction and a discharge, an outside heat exchanger, an inside heat exchanger, refrigerant expansion means, a single refrigerant flow reversing valve and interconnecting refrigerant conduit including portions of said refrigerant conduit that serially connect and allow reversible refrigerant flow through said flow reversing valve, said outside heat exchanger, said expansion means and said inside heat exchanger and having a heating mode refrigerant flow path in which said flow reversing valve is aligned so that refrigerant from said compressor discharge flows first from said flow reversing valve to said inside heat exchanger and a refrigerant flow path common to both said cooling and said defrosting modes of operation in which said flow reversing valve is aligned so that refrigerant from said compressor discharge flows first from said flow reversing valve to said outside heat exchanger, an apparatus for supplying heat to defrost said outside heat exchanger comprising:

heat storage means, in heat exchange relationship with that portion of said interconnecting refrigerant conduit that lies between said refrigerant flow reversing valve and said inside heat exchanger so that said heat storage means extracts and stores heat from said refrigerant while said system is operating in said heating mode of operation and transfers heat to said refrigerant while said system is operating in said defrosting mode of operation.

4. The apparatus of claim 3 in which said air conditioning system also has fan means for moving air through said outside heat exchanger and fan means for moving air through said inside heat exchanger, both of said fan means being interconnected so that neither of said fan means is capable of operation independently of the other of said fan means.

5. The apparatus of claim 3 in which said heat storage means contains a heat storage material that stores heat by a change in phase.

6. The apparatus of claim 3 in which said heat storage material has a melting point of about 54° C. (130° F.).

7. The apparatus of claim 4 in which said heat storage material is paraffin.

* * * * *

UNITED STATES PATENT AND TRADEMARK OFFICE

CERTIFICATE OF CORRECTION

PATENT NO. : 5,052,191

DATED : October 1, 1991

INVENTOR(S) : Ian M. Shapiro-Baruch

It is certified that error appears in the above-indentified patent and that said Letters Patent is hereby corrected as shown below:

Column 1: line 12 - start a new paragraph after "accumulations."; line 21 - change "evaporator" to read --evaporator.--; line 21 - after "be" insert --heated or cooled through the inside heat exchanger and another fan circulates air at outside ambient temperature through the outside heat exchanger.--; line 45 - change "us" to read --is--; line 46 - after "must" insert --be above freezing for this method to be successful. In the meantime, electric resistance heaters in the unit provide space heat. This method of defrosting can be a--; lines 46-48 - delete "Passive Defrost - The heat . . . exchanger".

Column 2: line 52 - change "inside" to read --outside-- and "outside" to read --inside--; line 53 - change "15D" to read --15B--; line 58- change "42" to read --41-- and "41" to read --42--.

UNITED STATES PATENT AND TRADEMARK OFFICE

CERTIFICATE OF CORRECTION

PATENT NO. : 5,052,191

DATED : October 1, 1991

INVENTOR(S) : Ian M. Shapiro-Baruch

It is certified that error appears in the above-indentified patent and that said Letters Patent is hereby corrected as shown below:

Column 3: line 8 - change "13" to read --11--; line 10 - change "14" to read --13--; line 11 - change "12" to read --11--; line 12 - change "13" to read --43--; lines 26-27 - delete "The warmed . . . exchanger."; line 28 - change "41" to read --42--; line 32 - change "42" to read --41--; line 48 - change "5420C" to read --54° C--.

Column 4: line 20 - change "scope of below" to read -- scope of the below--; line 34 [claim 1 line 12] - after "conduit" insert --including portions of said refrigerant conduit--.

Signed and Sealed this

Nineteenth Day of April, 1994

Bruce Lehman

BRUCE LEHMAN

*Commissioner of Patents and Trademarks*

*Attest:*

*Attesting Officer*